United States Patent [19]

Becker

[11] Patent Number: 5,031,531

[45] Date of Patent: Jul. 16, 1991

[54] DEVICE FOR ADJUSTING THE ROTATIONAL POSITION OF A CYLINDER OF A TURNING DEVICE IN A ROTARY PRINTING PRESS AND FOR AXIALLY DISPLACING AN ADJUSTING MEMBER FOR A GRIPPER CHANGE-OVER ON THE CYLINDER

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 346,570

[22] Filed: May 2, 1989

[30] Foreign Application Priority Data

May 2, 1988 [DE] Fed. Rep. of Germany ..... 3814831

[51] Int. Cl.[5] ..... B41F 21/10; B41F 3/40

[52] U.S. Cl. ..... 101/230; 101/411

[58] Field of Search ..... 101/230, 231, 407–412, 101/247, 248; 74/439; 271/82, 184, 902, 225

[56] References Cited

U.S. PATENT DOCUMENTS 4,147,105 4/1979 Becker ..... 101/230
4,787,261 11/1988 Becker ..... 101/248 X

FOREIGN PATENT DOCUMENTS 2620392 4/1978 Fed. Rep. of Germany .
3611325 10/1987 Fed. Rep. of Germany .

*Primary Examiner*—J. Reed Fisher

*Attorney, Agent, or Firm*—Herbert L. Lerner; Laurence A. Greenberg

[57] ABSTRACT

A device for adjusting a rotational position between coaxial fixed and adjusting gears and for changing-over a gripper by axially displacing an adjusting member on a cylinder of a turning device of a sheet-fed rotary printing press, includes a pressure member for effecting a spring coupling of the gears via a radially extending pressure lever. An adjusting member which reduces the spring force is axially displaceably guidable on the cylinder and becomes effective upon the pressure member only after traversing a distance for actuating a switch of an electrical safety device in a power supply circuit of a driving device. Another electrical safety device is between control positions of the adjusting member for interrupting the supply circuit to change over the gripper control. A connecting rod is axially displaceably guided in the cylinder and a spring which produces the spring force is in operative engagement with the pressure member for exerting the spring force thereon and is braced against the connecting rod. At least one clamping member is disposed in the adjusting member for changing-over the gripper control, and intermediate members, are provided, via which the one clamping member is displaceable radially to the cylinder and is pressable with the reaction force from the spring force against the cylinder for firmly clamping the clamping member and the cylinder to one another.

14 Claims, 5 Drawing Sheets

DEVICE FOR ADJUSTING THE ROTATIONAL POSITION OF A CYLINDER OF A TURNING DEVICE IN A ROTARY PRINTING PRESS AND FOR AXIALLY DISPLACING AN ADJUSTING MEMBER FOR A GRIPPER CHANGE-OVER ON THE CYLINDER

The invention relates to a device for adjusting the rotational position between a fixed gear and an adjusting gear disposed coaxially with the fixed gear as well as for a gripper change-over by axially displacing an adjusting member on a cylinder of a turning device of a sheet-fed rotary printing press, including a pressure member for effecting by spring force a force-locking coupling of the fixed gear with the adjusting gear via a radially extending pressure lever, an adjusting member actuatable for reducing the spring force, the adjusting member being axially displaceably guidable on the cylinder of the turning device and adapted to become effective upon the pressure member only after traversing a distance for actuating a switch of an electrical safety device in a power supply circuit of a driving device, and another electrical safety device of the power supply circuit of the driving device between control positions of the axially displaceable adjusting member for interrupting the supply circuit to change over gripper control.

A device of the foregoing general type has become known heretofore from German Published Non-Prosecuted Application (DE-OS) 36 11 325. The adjusting member of this conventional device is adjustable by means of a thread on a path which includes a first section wherein a spring force acting on a pressure lever increases from a low to a maximum value, and a second section wherein, while maintaining the maximum spring force acting on the pressure lever, an electric switch for the power supply circuit of the driving device is actuatable, so that the power supply circuit can be closed only when there is a fully effective coupling between the fixed gear and the adjusting gear. Conversely, there occurs initially an interruption of the power supply circuit before the force-locking coupling between the fixed gear and the adJusting gear can be released In this manner, assurance is provided that, only when there is a force-locking coupling of the adjusting gear with the fixed gear, can the printing machine be set into operation i.e., when the clamping between the two gears is firmly set.

The axial displacement of the adjusting member for changing-over or converting the gripper occurs in a construction heretofore known from German Patent 26 20 392 by means of an eccentric mechanism formed of an eccentric pin rotatably mounted in the adjusting member and of an eccentric joint engaging in a guide of the cylinder. The adjusting member is reliably secured by fastening screws opposite the cylinder so that it is necessary for displacing the adjusting member to climb on the printing machine in order to loosen the fastening screws of the adjusting member to twist or rotate the actuating member of the eccentric into the opposite end position with a tool suitable therefor, and then to screw the fastening screws tightly in again. For the axially displaceable adjusting member on the cylinder for changing-over cams for the gripper control, an electric end-position safety device has also become known heretofore from the last-mentioned German patent. The end-position safety device operates independently of the hereinafore-mentioned safety device of the device for clamping the fixed gear and the adjusting gear together.

Both safety or protection devices, the one for clamping the fixed gear and the adjusting gear together and the other for changing-over the gripper with the axially displaceable adjusting member call for an independent construction with all of the respective appertaining components. With devices in accordance with this state of the art, the change-over or conversion of the turning device in convertible printing machines for first form and perfector printing occurs in a complicated and time-consuming manner at two separate locations of the printing machine, one of the locations being on the machine-side and the other in the interior of the machine, with electrical fuses or safety devices which are independent of one another.

It is accordingly an object of the invention to provide the adJusting device of the foregoing general type wherein the change-over or conversion in the turning device is protected or secured more reliably than heretofore against faulty operation It is a further object of the invention to simplify simultaneously the change-over or conversion operation itself in order to reduce the time for setting-up or making-ready in the conversion operation while avoiding any faulty operation.

With the foregoing and other objects in view, there is provided, in accordance with the invention, a device for adjusting a rotational position between a fixed gear and an adjusting gear disposed coaxially with the fixed gear as well as for changing-over a gripper by axially displacing an adjusting member on a cylinder of a turning device of a sheet-fed rotary printing press, including a pressure member for effecting by spring force a force-locking coupling of the fixed gear with the adJusting gear via a radially extending pressure lever, an adjusting member actuatable for reducing the spring force, the adjusting member being axially displaceably guidable on the cylinder of the turning device and adapted to become effective upon the pressure member only after traversing a distance for actuating a switch of an electrical safety device in a power supply circuit of a driving device, and another electrical safety device of the power supply circuit of the driving device between control positions of the axially displaceable adjusting member for interrupting the supply circuit to change over the gripper control, comprising a connecting rod axially displaceably guided in the cylinder, spring means for producing the spring force, such spring means, on the one hand, being in operative engagement with the pressure member for exerting the spring force thereon and, on the other hand, being braced against the connecting rod, at least one clamping member disposed in the adJusting member for changing-over the gripper control, and intermediate members via which the one clamping member is displaceable radially to the cylinder and is pressable with the reaction force from the spring force against the cylinder for firmly clamping the clamping member and the cylinder to one another.

Due to these novel features of the invention, while maintaining the advantage of a clamping force for force-lockingly coupling the fixed gear and the adjusting gear together independently of the machine operator, the reaction force of the spring force is transmitted to at least one clamping member which firmly connects to the cylinder, the adjusting member for the gripper change-over the instant and as long as the fixed gear is force-lockingly coupled with the adjusting gear, so that then also the adjusting gear for the gripper change-over is firmly connected to the cylinder in the operating setting or phase of the printing machine and is thereby mechanically protected or secured independently of the effective clamping of both gears. In this regard, electrical or mechanical precautions must bee met therefor that this mechanical protection be possible only in the positioned locations, especially the end positions Greater safety is moreover achieved thereby, because both clamping operations are protected by only one switch, an electrical signal being able to be used for optical and/or acoustic display or indication of the intact clamping.

In accordance with another feature of the invention, one of the intermediate members is a two-armed pressure lever displaceable in the cylinder of the turning device about an articulating pin disposed transversely to the axis of the cylinder, one of the arms having a first bearing region engageable with an end of the connecting rod, the first bearing region being displaceable substantially axially in the cylinder, the other of the arms having a second bearing region engageable with at least one of the intermediate members, the second bearing region being displaceable substantially radially in the cylinder, the one intermediate member being operatively engageable with the one clamping member for transmitting the radial displacement of the second bearing region thereto. This advantageous feature has the objective of being able to use the simplest possible components for transmitting the reaction force from the spring force for clamping the adjusting member to the cylinder.

In accordance with an added feature of the invention, the one changing member and another clamping member are disposed in the adjusting member, and the one intermediate member being formed of a clamping strap braced centrally on the second bearing region in a balanced manner, the clamping strap having two ends respectively connected by a tension bolt to one of the clamping members.

In accordance with an additional feature of the invention, there are provided thrust washers formed of wear-resistant material and disposed between the clamping strap and the second bearing region, the thrust washers being formed with spherically-shaped sliding contact surfaces.

In accordance with again another feature of the invention, the clamping members are adjustably arranged, respectively, by means of a screw thread on one of the tension bolts.

In accordance with again a further feature of the invention, the tension bolts are disposed in bores formed at the ends of the clamping strap, the tension bolts being formed with end heads with which they engage the clamping strap from behind.

The last four features serve likewise to accomplish the objective of providing a construction of the device according to the invention out of the simplest possible components for use in transmitting the reaction force from the spring force for clamping the adjusting member and the cylinder together.

A further improvement for solving the aforementioned problem sought to be avoided by the invention of the instant application is to provide a rotatable or twistable eccentric by means of which the adjusting member for changing-over the gripper control, which is axially displaceable with respect to the cylinder of the turning device, is adjustable, the eccentric having an eccentric pin guided in the one part, and an eccentric Joint guided in the other part. Thus, in accordance with yet a further feature of the invention the clamping strap is disposed with a clearance affording movement thereof in a recess profiled complementarily to the clamping strap in the cylinder of the turning device.

In this way, it is possible for the actuating element for clamping the fixed gear and the adjusting gear together for adjusting rotational positions, and the actuating member for the gripper change-over to be arranged directly adjacent one another on the printing machine, so that it is no longer necessary for the gripper change-over, that the operator climb onto the machine and perform the work thereat which has been necessary heretofore. A considerable simplification of printing machine operation is thereby provided in changing over, which results also in a marked reduction in setting up and make-ready time with regard to the change-over.

In accordance with yet an added feature of the invention, the adjusting member is adjustable by a rotatable eccentric comprising an eccentric pin and an eccentric joint respectively disposed in the cylinder and the adJusting member, drive means connected to the eccentric pin and having an angular transmission, an actuating member for the angular transmission, the actuating member extending out of the cylinder and through the fixed gear to an end side thereof, the actuating member being located adjacent an actuating member for coupling the fixed gear with the adjusting gear.

In accordance with yet an additional feature of the invention, the eccentric pin and a control shaft mounted parallel to the axis of the connecting rod are in mutual meshing engagement by means of a helical gear transmission.

In accordance with still another feature of the invention, the actuating member for the angular transmission is directly fastened to an end of the control shaft, the control shaft extending through the fixed gear, a support plate and the pressure lever.

In accordance with still a further feature of the invention, there is provided a socket wrench for adjusting the actuating member for the angular transmission, and an electric/mechanical safety device cooperatively connected with the socket wrench and having a mechanical construction permitting application of the socket wrench to the actuating member for the angular transmission and withdrawal of the socket wrench therefrom exclusively in respective end positions of the adJusting member.

In accordance with still an added feature of the invention, the socket wrench is formed with two mutually parallel flat surfaces at two diametrically opposite sides on a flange edge engaging behind a safety plate, the safety plate being held by the support plate.

In accordance with still an additional feature of the invention, the actuating member for the angular transmission has a mark characterizing the end positions, and the safety has plate various symbols for perfector printing as well as for first form and perfector printing, the appertaining end position thereof, respectively, being indicated by the mark in connection with a symbol corresponding therewith.

In accordance with a concomitant feature of the invention, the eccentric joint is mounted in a friction-poor bearing with a control plate provided on the adjusting member.

These additional features provide further improvements with regard to use of simplified components and trouble-free operation thereof In this regard, it ought further to be noted that conventional means for protecting or securing the end positions of the axially displaceable adjusting member for gripper change-over are known from German Patent 26 20 392.

Other features which are considered as characteristic for the invention are set forth in the appended claims Although the invention is illustrated and described herein as embodied in a device for adJusting the rotational position of a cylinder of a turning device in a rotary printing press and for axially displacing an adjusting member for a gripper change-over on the cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
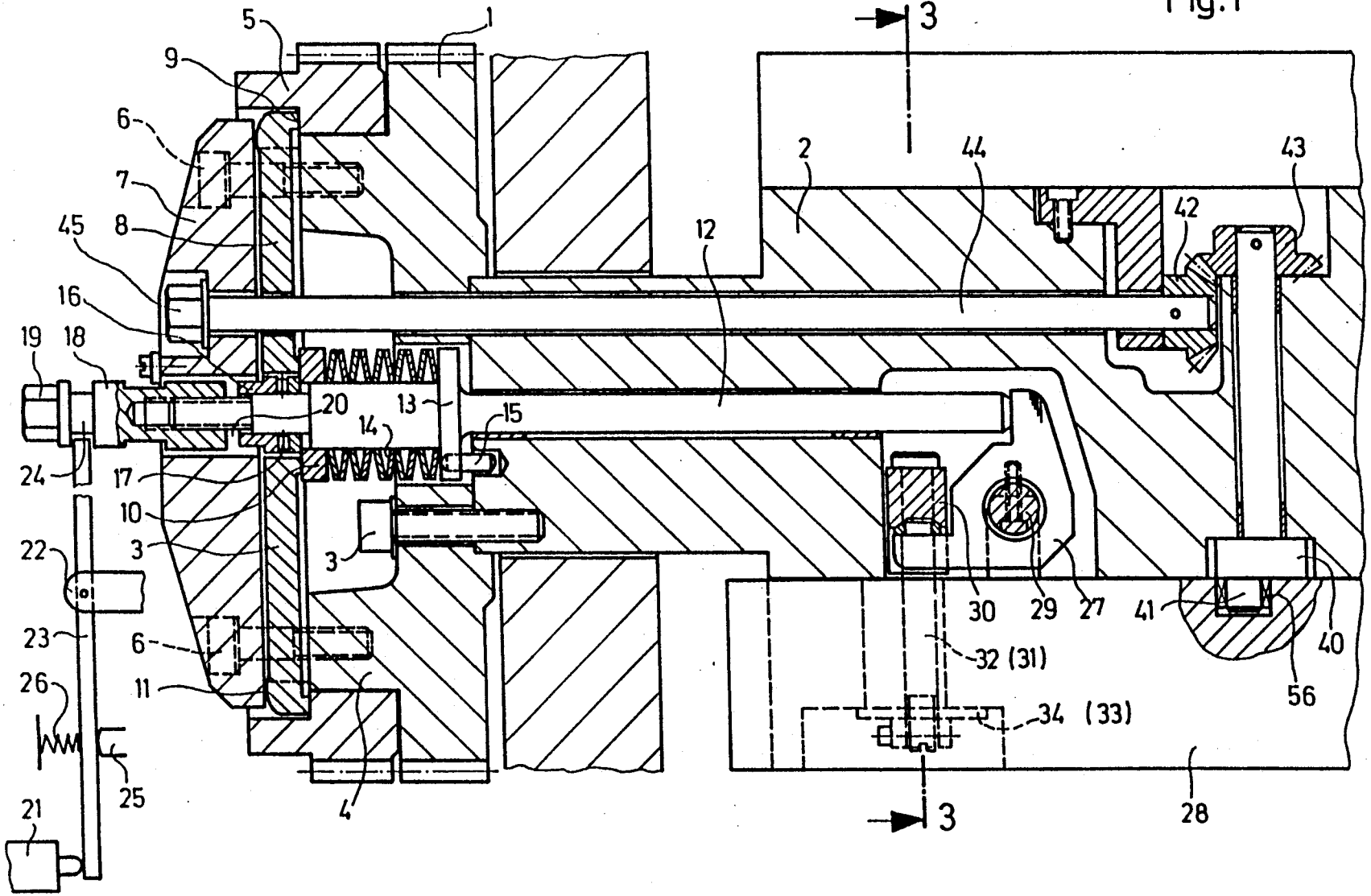
FIG. 1 is a longitudinal sectional view in axial plane of an end of a cylinder of a turning device wherein a fixed gear and an adJustable gear are force-lockingly coupled by clamping.

Referring now to the drawing and, first, particularly to FIG. 1 thereof, there is shown an embodiment of the invention having a fixed gear 1 fastened by screws 3, only one of which is shown, which are distributed about the periphery; to one end of a cylinder or shaft 2 of a turning device, only part of which is shown in the figure of the drawing in the interest of clarity. The fixed gear 1 is formed with an angular recess in a section along the axial plane, which is defined by a socket or collar proJection 4 wherein a crownlike adjusting gear 5 is arranged so as to be adjustable in angle of rotation with respect to the fixed gear 1. Both gears 1 and 5 are mutually couplable force-lockingly by clamping. For this purpose, a support plate 7 is fastened by several screws 6 to an end face of the socket projection 4. Several pressure levers 8, six in number in the illustrated embodiment, which extend radially in a uniform distribution on the circumference, are braced against the support plate 7. One end of each of these pressure levers 8 is disposed against a radial ring surface 9 on the adjusting gear 5, and the other end of each of the pressure levers 8 is disposed against a disc or washer 10 forming a spring-loaded pressure member, the pressure levers 8 on the opposite side thereof being braced by cams 11 thereon against the support plate 7. To increase the clamping force with a slight use of force, the cams 11 are arranged near the one end of the pressure levers 8, yet nevertheless between the locations thereof at which they bear against the adjusting gear 5 and against the disc 10, so that the pressure levers 8 form respective double levers with lever arms which are of unequal length The disc 10 is guided axially displaceably on a connecting rod 12 which, in turn, is mounted so as to be axially displaceable in the cylinder 2 in the direction of or parallel to the axis thereof and has a radial flange 13 forming an abutment for a compression spring 14. In the illustrated embodiment of FIG. 1 a column of cup springs arranged in a plurality of layers is provided as the compression spring 14 and abut, on the other hand, against the disc 10 so that they load the pressure levers 8 at the ends of the long lever arm with spring force from the spring 14 and thus independently of any body force. Ends of a pin 15 engage in bores formed, on the one hand, in the radial flange 13 and, on the other hand, in the cylinder 2 and secure the connecting rod 12 against rotation.

Figure 2:
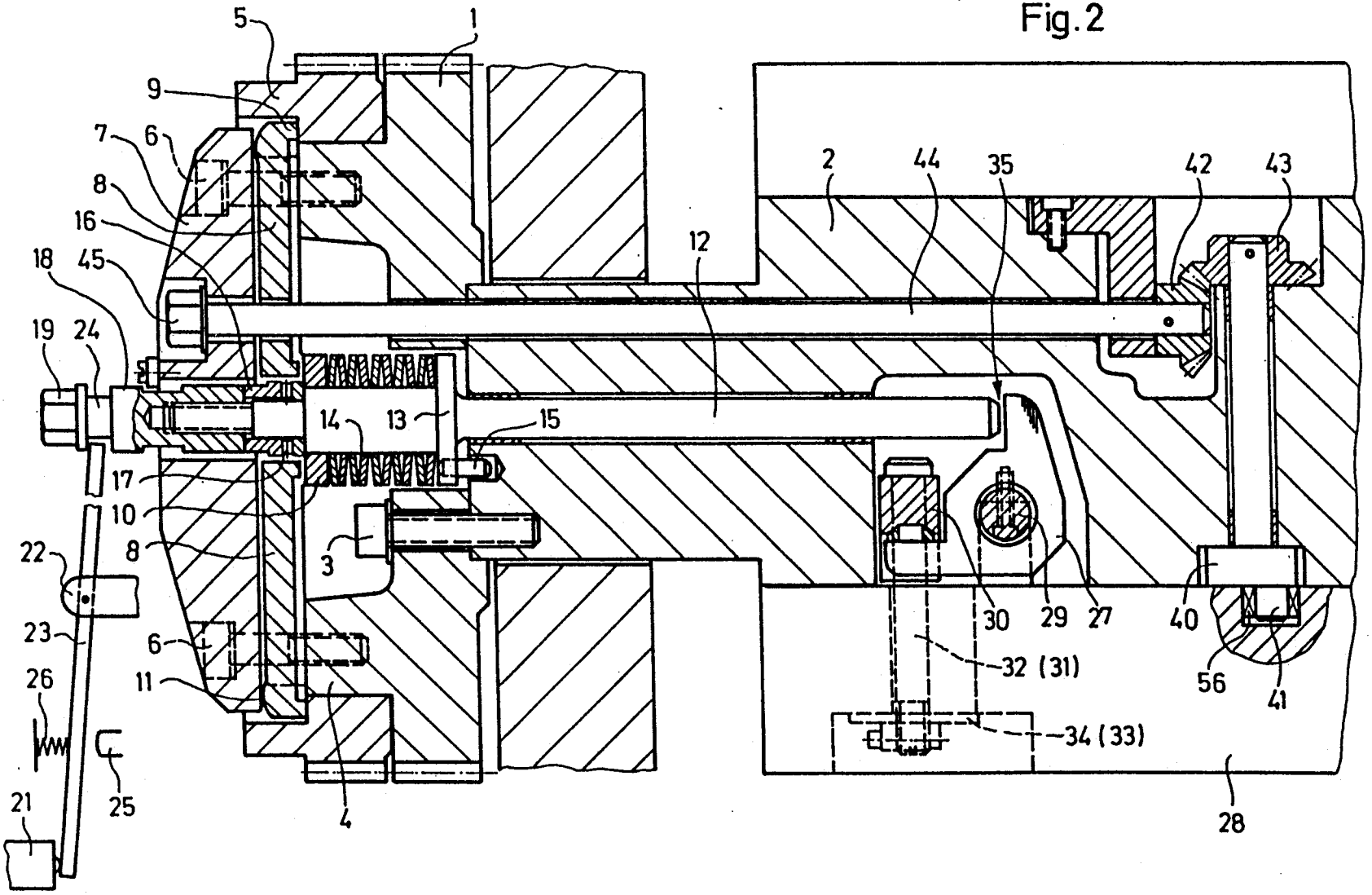
FIG. 2 is a view similar to that of FIG. 1 with the clamping action being released.

A thrust ring or collar 16 is connected with an integrated roller bearing 17 in vicinity of the pressure levers 8 on a section of the connecting rod 12 extending through the spring 14, one end of the thrust ring 16 engaging the disc 10, and a threaded sleeve 18 being displaceable towards or against the other end of the thrust ring 16, the threaded sleeve 18 having a female thread by which it is threadedly securable on a male thread formed on a free, outwardly extending end of the connecting rod 12 by means of an actuating member, for example an hexagonal head 19. Clearance 20 is provided between the threaded sleeve 18 and the thrust ring 16 so that the threaded sleeve 18, in order to release the clamping force effecting the coupling between the fixed gear 1 and the adjusting gear 5, must be displaced axially over this clearance 20 on a first section before the displacement of the threaded sleeve 18, in a second section, can exert forces on the thrust ring 16 in order to shift the latter with the disc 10 against the force of the spring 14 and, thereby, relieve the load on the pressure lever 8. Conversely, when the threaded sleeve 18 is displaced in the opposite direction, the full spring force of the spring 14 again initially acts upon the pressure lever 8 before the threaded sleeve 18 is displaced on the section at which the clearance 20 is located. The last-mentioned displacement serves for actuating a switch 21, a double lever 23 mounted on a pivot 22 which is fixed to the machine has an end which engages in an annular groove 24 formed at the periphery of the threaded sleeve 18. The other end of the double lever 23 acts upon an actuating member of a switch 21 and extends between an abutment or stop 25 as well as a spring 26, so that the stop 25 limits movement of the threaded sleeve 18 towards the outside i e towards the left-hand side of Fig 2, and accordingly the movement thereof on the section of the connecting rod 12 which determines the clearance 20 (FIG. 1). On the other hand, the spring 26 ensures the restoration or resetting of the double lever 23 into the position thereof in which it is in contact with the stop 25 and wherein the switch 21 opens the power supply circuit of the printing machine with the aforementioned clamping i.e., force-locking coupling of both gears 1 and 5. The printing machine is thereby reliably switched off before the clamping effect can be released, and is able to be switched on again only if the clamping action is fully effective. This condition is represented in FIG. 1, whereas FIG. 2 illustrates the phase wherein the clamping effect has been released and wherein the threaded sleeve 18 has initially been screwed onto the connecting rod 12 towards the righthand side in the plane of FIG. 2 towards the path of the clearance 20, and has actuated the switch 21 for interrupting the power supply circuit in the drive of the printing machine, before the thrust ring 16 for respectively reducing and increasing the spring force at the ends of the pressure lever 8 has been axially shifted to abut against the disc 10. To limit this movement, the thrust ring 16 is arranged on a step or shoulder of the connecting rod 12 which has a diameter smaller than that of the part passing through the spring 14, so that a step-shaped stop is formed for displacing the thrust ring 16.

Figure 3:
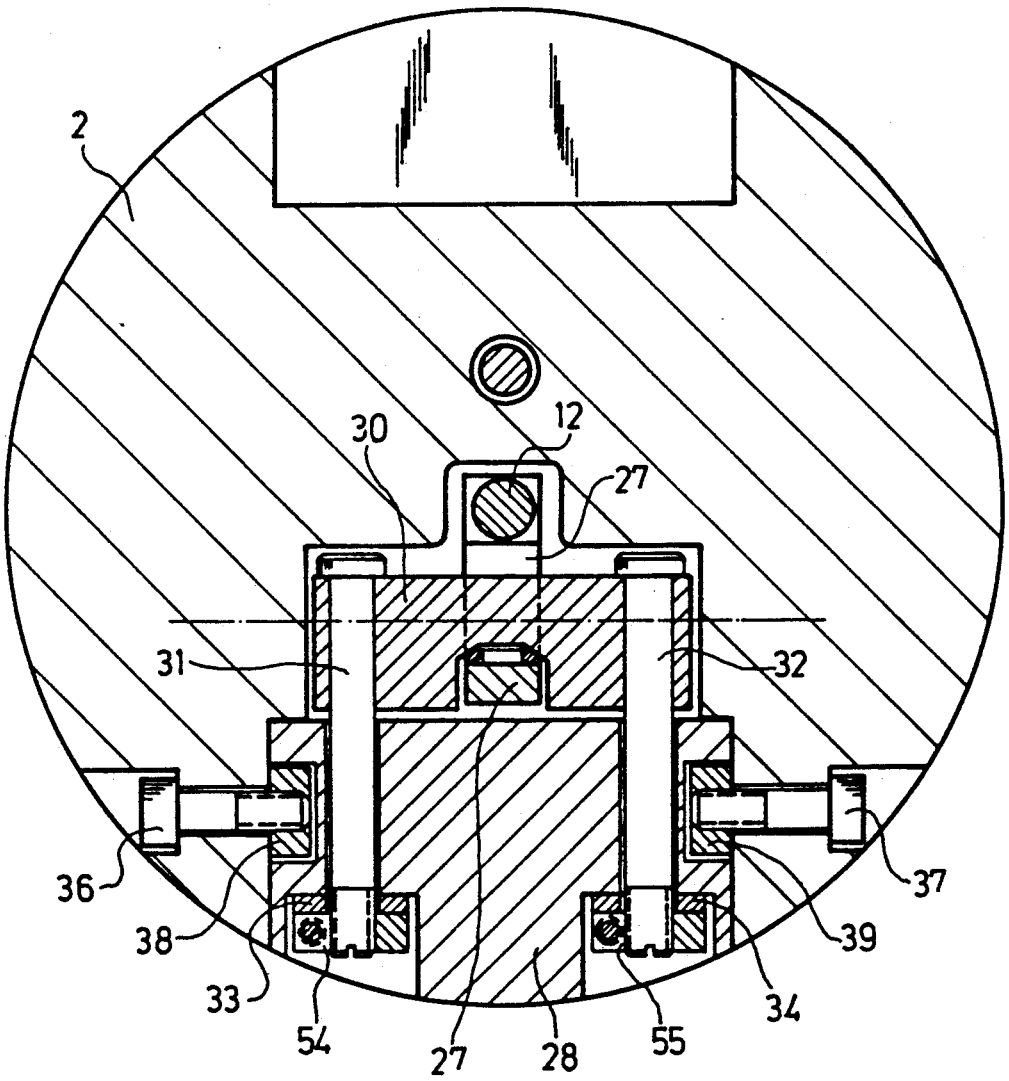
FIG. 3 is a cross-sectional view of FIG. 1 taken along the line 3—3 in direction of the arrows.
Figure 4:
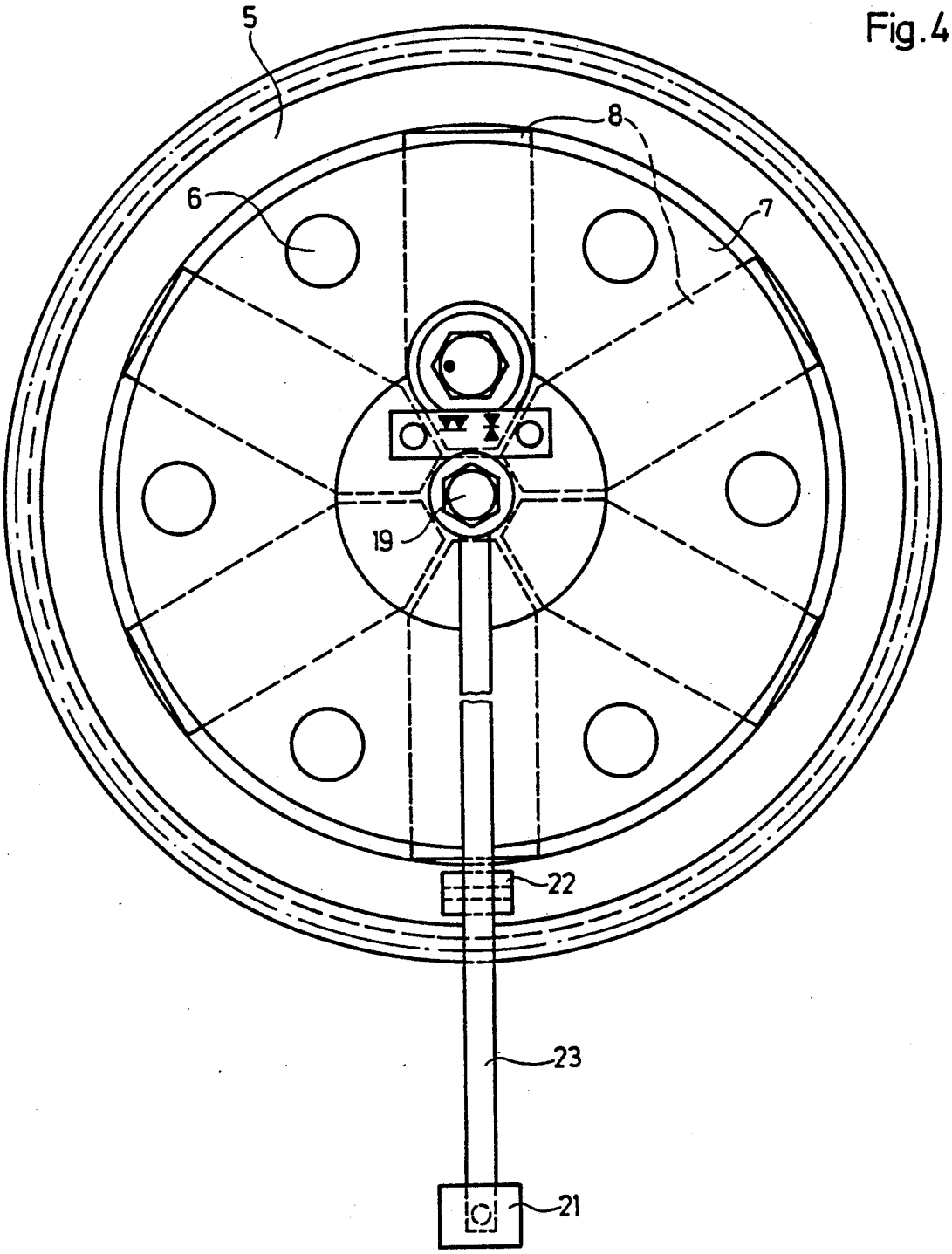
FIG. 4 is an end view of the cylinder of FIG. 1.

An inwardly directed end of the connecting rod 12 located opposite to the male thread end acts against an arm of a second, angularly formed pressure lever 27 which is movable, in the cylinder 2 in vicinity of an axially displaceable adjusting member 28, about a joint or articulating pin 29 which is arranged transversely to the longitudinal axis of the cylinder 2. The other arm of the angularly formed pressure lever 27 engages under a clamp strap 30, somewhat at the middle of the latter (FIG. 3), the ends of the clamp strap 30, as shown more clearly in FIG. 3, being connected by respective tension bolts 31 and 32 to clamping members 54 and 55 located in outwardly lying recesses formed in the adjusting member 28, and acting via washers 33 and 34 against the ends of the clamp strap 30. The tension bolts 31 and 32 are formed with end heads which engage behind the clamp strip 30 and extend through the bores formed in the clamp strip 30 and in the adJusting member 28 The connecting rod 12 transmits the spring force of the spring 14 to the clamp strip 30 via the angularly shaped pressure lever 27, so that the spring force acts as a clamping force on the clamping members 54 and 55 via the tension bolts 31 and 32, and the adjusting member 28 presses against seating surfaces formed on the cylinder 2. To attain uniform clamping forces in both clamping members 54 and 55, the one arm of the pressure lever 27 and the clamp strip 30 are both formed with substantially spherical surfaces with which they are in formed of a wear-resistant material, if necessary or free ends of the tension bolts 31 and 32 in order to an adjustment of the clamping forces and of a clearance 35 between the connecting rod 12 and the transmission members, and in order to ensure the axial displaceability of the adjusting member 28, if the spring 14 for respectively reducing and increasing the spring force acting upon the pressure levers 8 is compressed, the connecting rod 12 shifting towards the left-hand side, as viewed in FIG. 2, until the thrust ring 16 engages a stop shoulder of the connecting rod 12. The clearance 35 between the connecting rod 12 and the intermediate members of the clamping system of the axially displaceable adjusting member 28 is thus visible if the clamping effect is released. Conversely thereto, the clearance 20 between the threaded sleeve 18 and the thrust ring 16 is visible if the clamping action is set or started.

The axially displaceable adjusting member 28 for changing-over the gripper is constructed as a slide extending over the width of the printing machine in a recess formed in the cylinder 2 and guided on adjustable guide rails 38 and 39 on the drive side and on the operating side of the printing machine. Clamping of the adjusting member 28 on only one side is thereby adequate.

Figure 5:
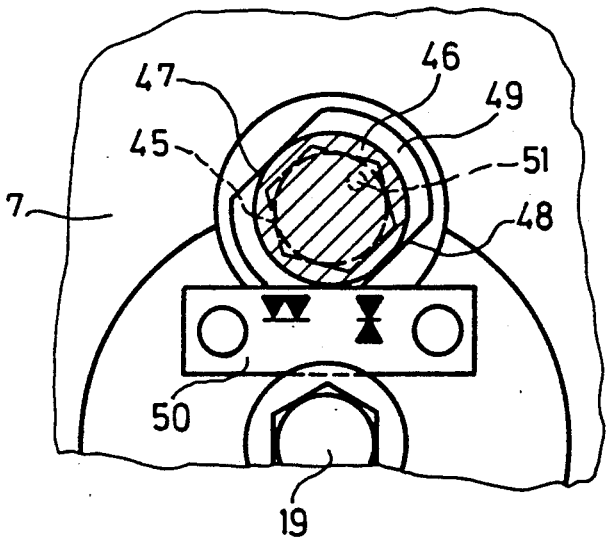
FIG. 5 is an enlarged fragmentary view of FIG. 4 showing the gripper change-over or conversion and, in cross section, a shaft of a key for adjusting an actuating member in an intermediate position.
Figure 6:
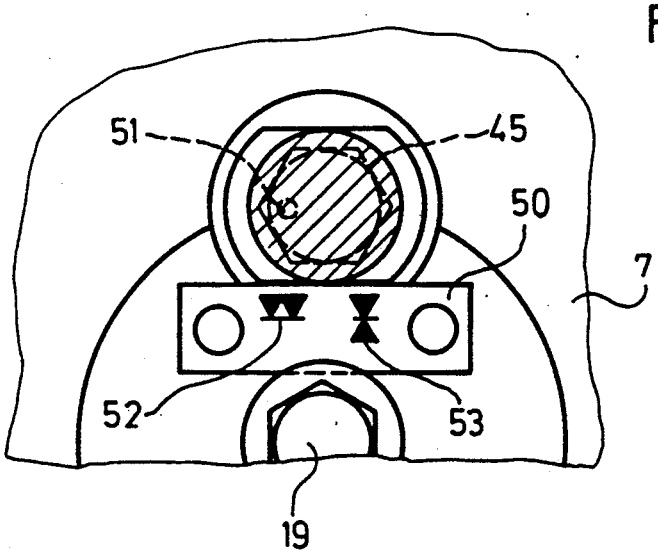
FIG. 6 is a view similar to that of FIG. 5 showing the actuating member in an end position thereof.

To axially adjust the adjusting member 28 for the gripper change-over, there is provided an eccentric mechanism formed of an eccentric pin 40 mounted, in contrast with conventional constructions, in the cylinder 2 transversely to the axis thereof, and an eccentric Journal 41 engaging in a bearing 56 of the adjusting member 28. The bearing 56 is formed, for example, of a switch plate made of wear-resistant material. The adjustment of the eccentric pin 40 is effected by means of miter-wheel gearing mounted likewise in the cylinder 2 and formed of two helical gears 42 and 43 via a control shift 44 which is disposed parallel to the axis of the cylinder 2 rotatably within the latter. The helical gear 42 is fastened to an inner end of the control shaft 44. The other end of the control shaft 44 extends outwardly through the support plate 7 and carries an actuating member thereat which is located adjacent the means for clamping the adjusting gear 5 and the fixed gear 1 together The adjustment of the adjusting member 28 can thereby occur somewhat at the same location at which the clamping, which effects the force-locking coupling of the two gears 1 and 5 as well as of the adJusting member 28 with the cylinder 2, is provided. The protection afforded by the combination of the clamping between the fixed gear 1 and the adJusting gear 5 with a clamping between the adjusting member 28 and the cylinder 2 permits and axial adJustment, but only after this clamping is released, however. Limit or end position security by electrical switching means in a conventional manners remains unaffected thereby. A hexagon head 45 for a socket wrench 46 is provided on the control shaft 44 for axially displacing the adjusting member 28 from one to another end position This socket wrench 46, as shown in FIGS. 5 and 6, has a construction which permits the application thereof to and removal thereof from the hexagon head 45, which acts as actuating member for the control shaft 44, exclusively in the set end positions of the adJusting member 28. To this end, the socket wrench 46 is formed, in a conventional manner., with two mutually parallel flat surfaces 47 and 48 at two diametrically opposite sides on a flange edge 49, which engages behind a safety plate 50 fastened to the support plate. FIG. 6 shows the socket wrench 46 in a position wherein removal thereof from the hexagon head 45 is possible, and corresponds to one end position of the adJusting member 28.

FIG. 5 shows a possible intermediate setting wherein the flange edge 49 engages behind the safety plate 50, so that the socket wrench 46 cannot be withdrawn from the hexagon head 45 on the control shaft 44. The hexagon head 45 has a mark 51 on the front side thereof for marking the end positions, whereas different symbols 52 and 53 for perfector printing as well as for first form and perfector printing are applied to the safety plate 50, the mark 51 in connection with the respective symbols 52 and 53 indicating the appertaining and positions for the different printing modes.

The foregoing is a description corresponding in substance to German Application P 38 14 831.5, dated May 2, 1988, the International priority of which is being claimed for the instant application, and which is hereby made part of this application.

I claim:

1. In a sheet-fed rotary printing press having a fixed gear, an adjusting gear disposed coaxially therewith, a sheet turning device including a cylinder coaxial with the fixed gear and the adjusting gear, an adjusting member axially displaceable on the cylinder for changing-over a gripper on the turning device, and a device for adjusting a rotational position between the fixed gear and the adjusting gear as well as for axially displacing the adjusting member, comprising means including a radially extending pressure lever engageable with the adjusting gear, a spring-loaded pressure member engageable with said pressure lever for transmitting a spring force therethrough to the adjusting gear for affecting a force-locking coupling of the adjusting gear with the fixed gear, means on the cylinder of the turning device for axially displaceably guiding the adjusting member over a given distance, means cooperatively connected to said adjusting member for actuating a switch after said given distance has been traversed, a connecting rod disposed in said cylinder so as to be axially guidable therein, spring means for producing the spring force being, on the one hand, in operative engagement with said pressure member for exerting the spring force thereon and, on the other hand, being braced against said connecting rod, at least one clamping member disposed in the adjusting member, and means for displacing said clamping member radially to the cylinder and for pressing said one clamping member with a reaction force from the spring force against the cylinder for firmly clamping said clamping member and the cylinder to one another.

2. Device according to claim 15, including an articulating pin mounted in the cylinder transversely to the axis thereof, and wherein said last-mentioned means comprise a two-armed pressure lever displaceable in the cylinder of the turning device about said articulating pin, one of said arms having a first bearing region engageable with an end of said connecting rod, said first bearing region being displaceable substantially axially in the cylinder, the other of said arms having a second bearing region displaceable substantially radially in the cylinder, and a clamping strap disposed in said cylinder and engageable by said second bearing region, said clamping strap being operatively engageable with said one clamping member for transmitting the radial displacement of said second bearing region thereto.

3. Device according to claim 2, wherein said one clamping member and another clamping member are disposed in the adjusting member, and said clamping strap is braced centrally on said second bearing region in a balanced manner, said clamping strap having two ends respectively connected by tension bolts to one of said clamping members.

4. Device according to claim 3, including thrust washers formed of wear-resistant material and disposed between said clamping strap and said second bearing region, said thrust washers being formed with spherically-shaped sliding contact surfaces.

5. Device according to claim 3, wherein both said clamping members are adjustably arranged, respectively, by means of a screw thread on one of said tension bolts.

6. Device according to claim 3, wherein said tension bolts are disposed in bores formed at said ends of said clamping strap, said tension bolts being formed with end heads with which they engage said clamping strap from behind.

7. Device according to claim 3, wherein said clamping strap is disposed with a clearance affording movement thereof in a recess profiled in the cylinder of the turning device complementarily to said clamping strap.

8. Device according to claim 15, wherein the adjusting member is adjustable by a rotatable eccentric comprising an eccentric pin and an eccentric joint respectively disposed in the cylinder and the adjusting member, drive means connected to said eccentric pin and having an angular transmission, an actuating member for said angular transmission, said actuating member extending out of the cylinder and through the fixed gear to an end side thereof, said actuating member being located adjacent an actuating member for coupling the fixed gear with the adjusting gear.

9. Device according to claim 8, wherein said eccentric pin and a control shaft mounted parallel to the axis of said connecting rod being in mutual meshing engagement by means of a helical gear transmission.

10. Device according to claim 9, including a support plate secured to said fixed gear, and wherein said actuating member for said angular transmission is directly fastened to an end of said control shaft, said control shaft extending through the fixed gear, said support plate and the pressure lever.

11. Device according to claim 10, wherein said adjusting member is movable to respective end positions thereof, and including a socket wrench for adjusting said actuating member for said angular transmission, and an electric and mechanical safety device cooperatively connected with said socket wrench and having a mechanical construction permitting application of said socket wrench to said actuating member for said angular transmission and withdrawal of said socket wrench therefrom exclusively in said respective end positions of the adjusting member.

12. Device according to claim 11, including a safety plate held by said support plate, and wherein said socket wrench is formed with two mutually parallel flat surfaces at two diametrically opposite sides on a flange edge engaging behind said safety plate.

13. Device according to claim 12, wherein said actuating member for said angular transmissin has a mark characterizating said end positions, and said safety plate has various symbols for perfector printing as well as for first form and perfector printing, the appertaining end position thereof, respectively, being indicated by said mark in connection with a symbol corresponding therewith.

14. Device according to claim 8, including a control plate disposed on the adjusting member, and wherein said eccentric joint is mounted in a friction-poor bearing with said control plate.

* * * * *

UNITED STATES PATENT AND TRADEMARK OFFICE

CERTIFICATE OF CORRECTION

PATENT NO. : 5,031,531

DATED : July 16, 1991

INVENTOR(S) : Willi Becker

It is certified that error appears in the above-indentified patent and that said Letters Patent is hereby corrected as shown below:

Column 9, line 23, "15" should read --1--.

Signed and Sealed this

Thirty-first Day of August, 1993

Bruce Lehman

*Attest:*

BRUCE LEHMAN

*Attesting Officer*

*Commissioner of Patents and Trademarks*